US005262583A

United States Patent [19]

Shimada

[11] Patent Number: 5,262,583

[45] Date of Patent: Nov. 16, 1993

[54] KEYBOARD INSTRUMENT WITH KEY ON PHRASE TONE GENERATOR

[75] Inventor: Yoshihisa Shimada, Hamamatsu, Japan

[73] Assignee: Kabushiki Kaisha Kawai Gakki Seisakusho, Shizuoka, Japan

[21] Appl. No.: 913,944

[22] Filed: Jul. 17, 1992

[30] Foreign Application Priority Data

Jul. 19, 1991 [JP] Japan ..... 3-204825

[51] Int. Cl.[5] ..... G10H 1/18; G10H 1/38; G10H 1/42

[52] U.S. Cl. ..... 84/609; 84/611; 84/613; 84/615; 84/626; 84/DIG. 12; 84/DIG. 22

[58] Field of Search ..... 84/615, 626, 633-638, 84/609-614, DIG. 12, DIG. 22

[56] References Cited

U.S. PATENT DOCUMENTS 4,526,080 7/1985 Amano ..... 84/DIG. 12
4,554,854 11/1985 Kato ..... 84/DIG. 12
5,063,820 11/1991 Yamada ..... 84/609

*Primary Examiner*—Stanley J. Witkowski

[57] ABSTRACT

An electronic keyboard instrument includes note data memory (35) for storing note data strings of a plurality of different short phrases, and a tone generator (37) for generating tones on the basis of a note data string read out from the note data memory (35). In response to a key depression operation, a note data string of a short phrase assigned to the ON key is selected and read out. Tone strength data of the readout note data string are multiplied with a key operation strength value, and product data are output to the tone generator (37). A player performs an adlib play upon a combination of the phrases. The tone volume can be controlled in units of phrases according to key touch data.

5 Claims, 12 Drawing Sheets

KEYBOARD INSTRUMENT WITH KEY ON PHRASE TONE GENERATOR

BACKGROUND OF THE INVENTION

1. Field of the Invention

The present invention relates to a phrase play apparatus for an electronic musical instrument, which can obtain tones of a phrase including a plurality of notes in response to a key operation with one finger.

2. Description of the Related Art

In general, an electronic keyboard (electronic piano, or the like) has an auto-accompaniment function for automatically playing rhythm, chord or bass patterns. Some electronic musical instruments have a function (a so-called one-finger adlib play function). With this function, different phrases each including notes in about one bar are assigned to a plurality of keys, and these phrases are selectively read out in response to a key operation with one finger, thereby obtaining an adlib play effect upon a combination of a series of phrases.

When the above-mentioned adlib phrase play is performed using, e.g., a conventional electronic keyboard, the tone volume of tones is determined on the basis of the velocity value (tone generation strength value) of note data, and the velocity value is fixed to a predetermined programmed value. Therefore, even when an adlib play is performed, since the tone volume is fixed, the play undesirably becomes monotonous.

SUMMARY OF THE INVENTION

It is an object of the present invention to provide a phrase play apparatus, which can vary the tone volume of adlib phrase play tones according to the key depression strength of a key operation, and allows even a beginner to perform an adlib play that can express his or her emotions.

In order to achieve the above object, according to the present invention, there is provided a phrase play apparatus comprising: note data storage means for storing note data strings including a plurality of different short phrases, the phrases being assigned to different keys; tone generation means for generating tones on the basis of the note data string read out from the note data storage means; means, responsive to a keyboard operation, for selecting and reading out a note data string of a short phrase corresponding to an operated key; detection means for detecting a key depression strength; and multiplication means for multiplying each tone generation strength data of the readout note data with a key operation strength value, and outputting product data as a tone generation strength value to the tone generation means.

The tone volume in an adlib play can be varied in correspondence with the key depression velocity of a key operation, and a player can make a play with expressions.

DETAILED DESCRIPTION OF THE PREFERRED EMBODIMENT

Figure 1:
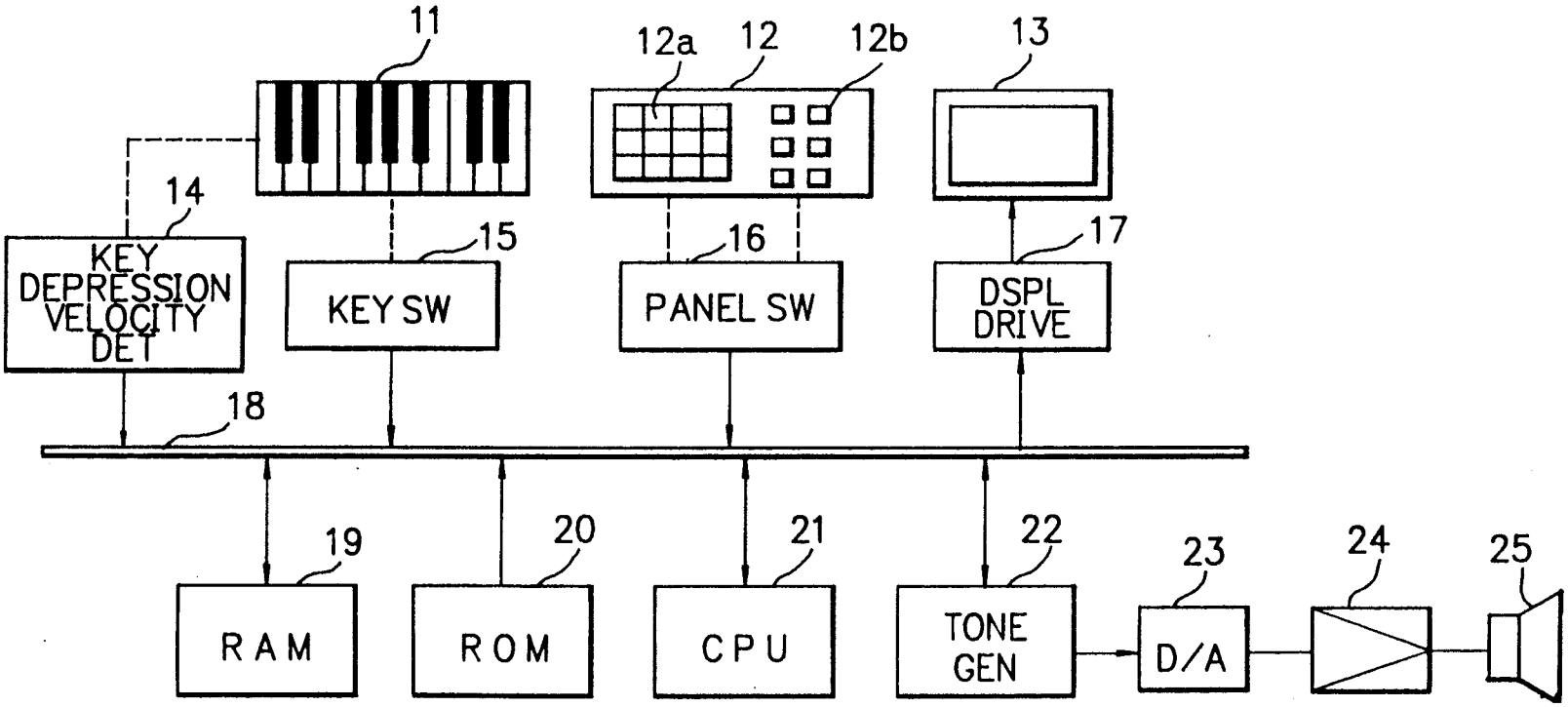
FIG. 1 is a block diagram of an electronic musical instrument as an embodiment of a phrase play apparatus according to the present invention.

FIG. 1 is a block diagram showing principal part of an electronic musical instrument according to an embodiment of the present invention. This electronic musical instrument comprises a keyboard 11, an operation panel 12, a display device 13, a key depression velocity detection circuit 14, and the like.

The circuit section of the electronic musical instrument comprises a microcomputer including a CPU 21, a ROM 20, and a RAM 19, which are connected to each other through a bus 18. The CPU 21 detects operation information of the keyboard 11 from a key switch circuit 15 connected to the keyboard 11, and detects operation information of panel switches from a panel switch circuit 16 connected to the operation panel 12.

The type of rhythm or instrument selected on the operation panel 12 is displayed on the basis of display data supplied from the CPU 21 to the display device 13 through a display drive 17.

The CPU 21 supplies note information corresponding to a keyboard operation, and parameter information such as a rhythm, a tone color, or the like corresponding to a panel switch operation to a tone generator 22. The tone generator 22 reads out PCM tone source data from a waveform memory section of the ROM 20 on the basis of the input information, processes the amplitude and envelope of the readout data, and outputs the processed data to a D/A converter 23. A tone signal digital/analog-converted by the D/A converter 23 is supplied to a loudspeaker 25 through an amplifier 24.

The ROM 20 stores auto-accompaniment data. The CPU 21 reads out auto-accompaniment data corresponding to an operation of an auto-accompaniment selection button on the operation panel 12 from the ROM 20, and supplies the readout data to the tone generator 22. The tone generator 22 reads out waveform data of, e.g., chord tones, bass tones, drum tones, and the like corresponding to the auto-accompaniment data from the ROM 20, and outputs the readout data to the D/A converter 23. Therefore, auto-accompaniment chord tones, bass tones, and drum tones can be obtained from the loudspeaker 25 together with tones corresponding to key operations.

Figure 2:
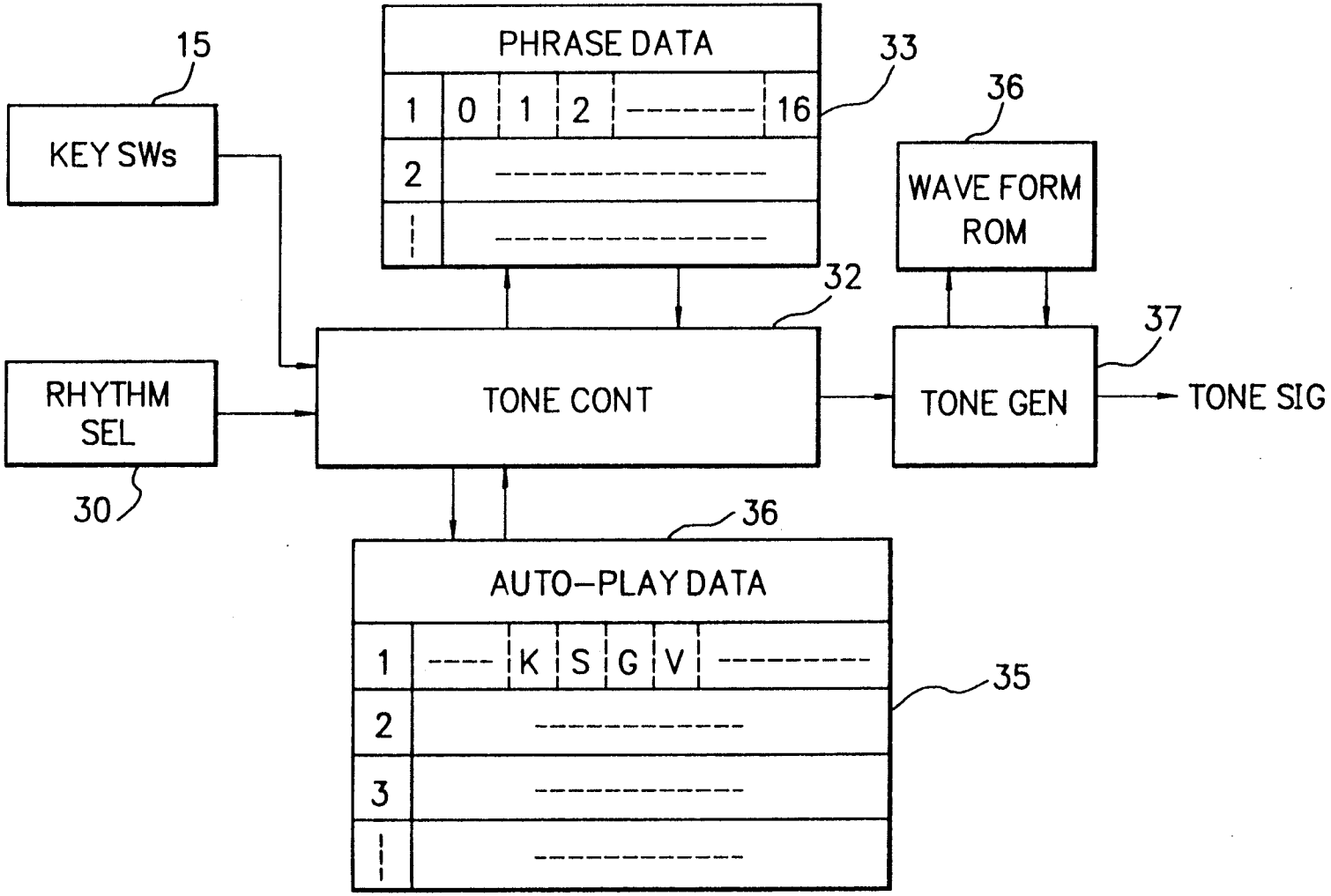
FIG. 2 is a block diagram showing elemental features of the phrase play apparatus of the present invention.

FIG. 2 is an elemental block diagram of the electronic musical instrument shown in FIG. 1. A rhythm selection section 30 comprises ten-key switches **12*a* (see FIG. 1) arranged on the operation panel 12**.

The operation panel 12 is also provided with selection buttons **12*b*** for selecting a rhythm play mode, an auto chord accompaniment mode, an adlib phrase play mode, and the like.

Figure 3:
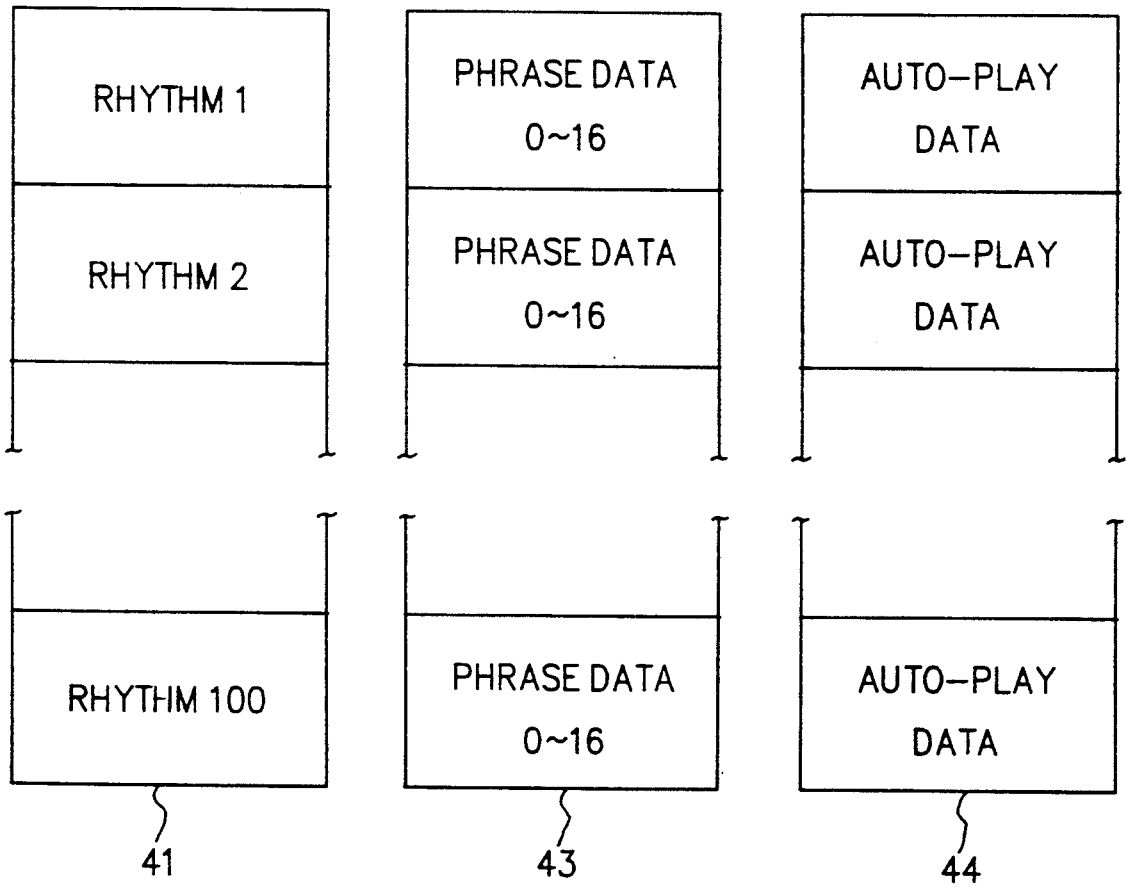
FIG. 3 shows the format of auto-play data.

A phrase data memory 33 connected to a tone controller 32 is allocated on the ROM 20, and has a phrase data table 43 including 17 different phrase data assigned to 17 keys (0 to 16) in units of rhythms, as shown in FIG. 3.

Each phrase data includes play pattern data for reading out note data for about one bar from a play data memory. In the adlib phrase play mode, phrases are assigned to specific 17 keys in correspondence with the selected rhythm. When one key is depressed, corresponding phrase data is read out from the phrase data memory 33, and note data including a 4-beat phrase are read out from an auto-play data memory 36 on the basis of the readout data. The readout note data are played. Since all the phrases corresponding to the 17 keys are different from each other, a player can easily enjoy an adlib play by operating keys at intervals of, e.g., four beats.

The tone controller 32 reads out auto-play data from the auto-play data memory 36 on the basis of an auto-play pattern or phrase data, modifies the readout auto-play data with data for designating a tone volume, a tone color, an instrument, or the like, and outputs the modified data to a tone generator 37.

Figure 4:
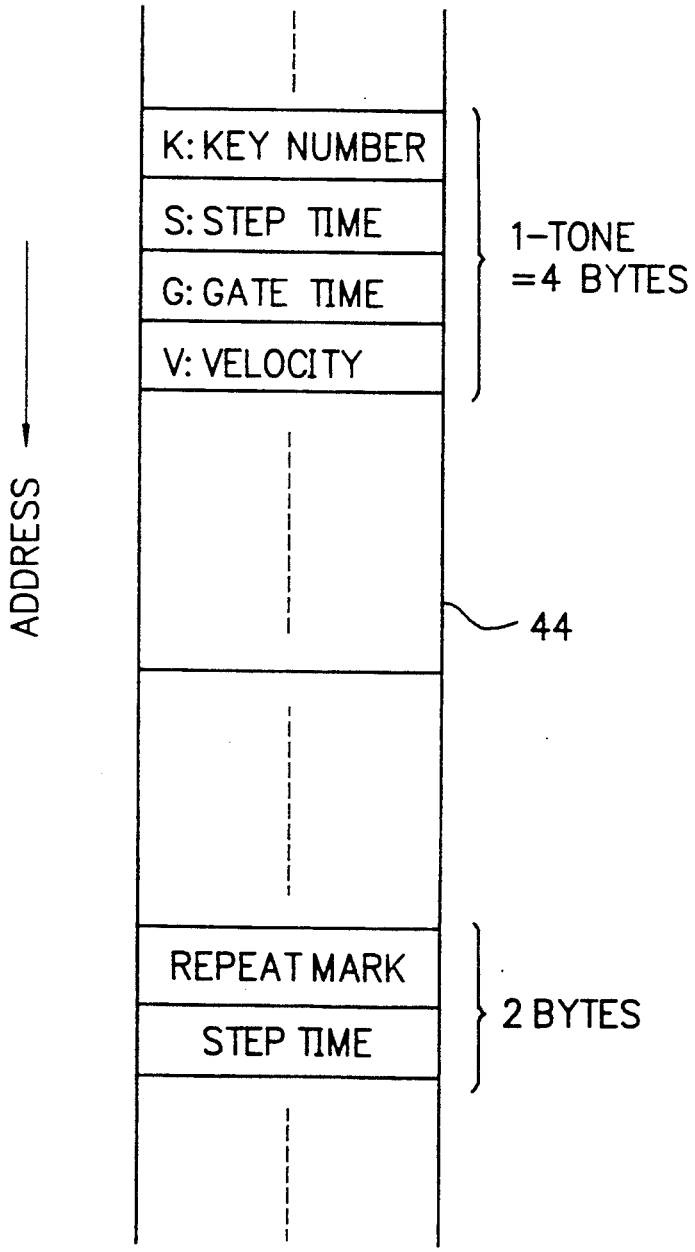
FIG. 4 shows the architecture of note data read out according to auto-play pattern data.

The auto-play data memory 36 is allocated on the ROM 20, and comprises a table storing note data strings for an auto-accompaniment of chord tones, bass tones, drum tones, and the like in units of rhythms, as shown in FIG. 4 showing the format of the auto-play data. Each note data includes key (interval) number data, tone generation timing data, gate time data, tone volume data, and the like. Note that the ROM 20 comprises a table 41 storing rhythm numbers in units of rhythms, as shown in FIG. 3.

The tone generator 37 reads out a corresponding PCM tone source waveform from a waveform ROM 36 on the basis of note data from the tone controller 32, and forms a tone signal. Thus, auto-play tones can be obtained.

FIG. 4 partially shows note data 44 accessed through the auto-play pattern data or phrase data. One note in note data includes four bytes, i.e., a key number K, a step time S, a gate time G, and a velocity V.

The key number K represents a scale, the step time S represents a tone generation timing, the gate time G represents a tone generation duration, and the velocity V represents a tone volume (key depression pressure). In addition, the note data includes tone color data, a repeat mark of a note pattern, and the like.

The note data are sequentially read out from the auto-play data memory 36 in units of four bytes from an address indicated by the phrase data. The tone controller 32 in FIG. 2 performs address control on the basis of the phrase data, and supplies the readout note data to the tone generator 37.

Figure 5:
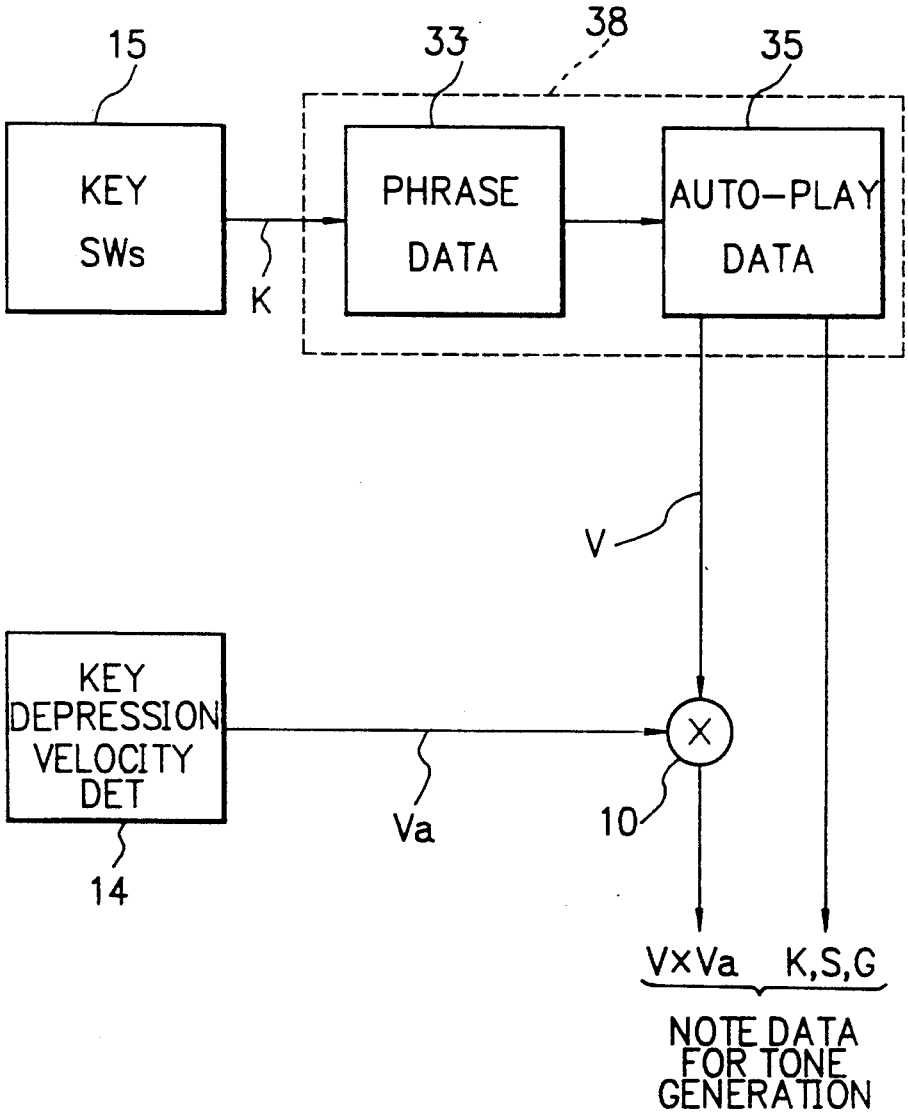
FIG. 5 is a block diagram showing the functions of the principal part of the present invention.

FIG. 5 is a functional block of this embodiment. As shown in FIG. 5, the key number K detected by the key switch circuit 15 is supplied to the phrase data memory 33 allocated on a note data storage means 38. Thus, corresponding address data is read out from the phrase data memory 33, and the readout data is output to the auto-play data memory 36 also allocated on the note data storage means 38.

The auto-play data memory 36 reads out the key number K, the step time S, the gate time G, the velocity V, and the like of the note data constituting a four-beat phrase on the basis of the address data supplied from the phrase data memory 33, and reproduces these data.

Of these reproduced data, the key number K, the step time S, and the gate time G are directly supplied to the tone controller 32. The velocity V is supplied to a multiplier 10.

The multiplier 10 also receives a velocity value Va of a key operation detected by the key depression velocity detection circuit 14. Therefore, the multiplier 10 multiplies the 8-bit velocity data V of the phrase and the 8-bit velocity data Va based on the key depression, thus generating 16-bit data.

Upper 8 bits of the generated 16-bit data are extracted, and are multiplied with a correction value (e.g., multiplied with 2 as the correction value). Thus, since this product data is used as velocity data, the tone volume in the adlib phrase play mode can be varied according to a key operation.

Note that one phrase includes four notes, and a key operation is performed once per phrase. Therefore, the velocity value of the key operation is commonly multiplied with the velocity values of the four notes.

FIGS. 6 to 12 are flow charts showing auto-play control using phrase data.

Figure 6:
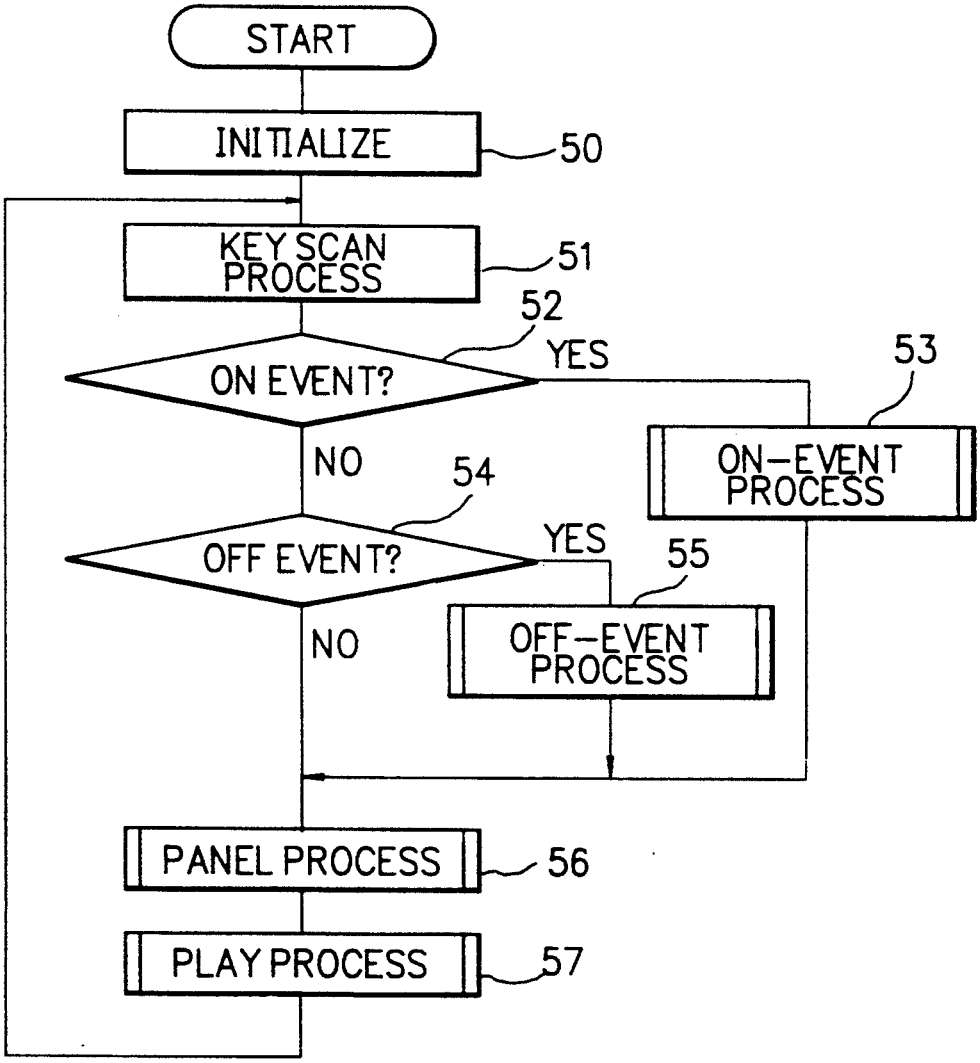
FIG 6 to 12 are flow charts showing auto-play control.

Initialization is performed in step 50 in FIG. 6, and operations at the keyboard 11 are scanned in step 51. If an ON-event of a key is detected, the flow advances from step 52 to ON-event processing in step 53; if an OFF-event of a key is detected, the flow advances from step 54 to OFF-event processing in step 55.

If no key event is detected, panel operation scan processing is performed in step 56, and play processing of tones is performed in step 57. Thereafter, the flow loops to step 51.

Figure 7:
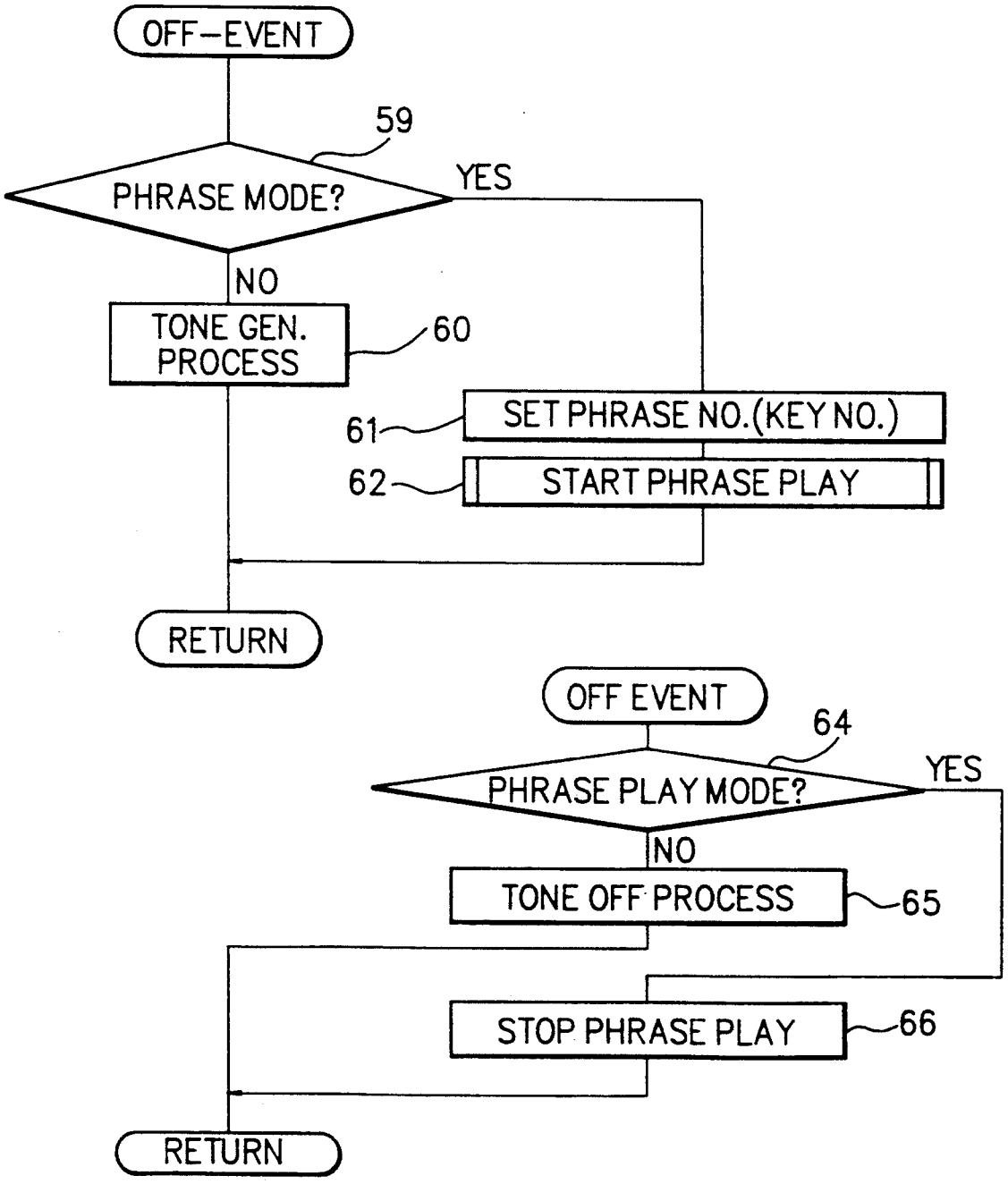

FIG. 7 shows the key ON- and OFF-event processing routines. When an ON-event is detected, it is checked in step 59 if the phrase play mode is selected. If NO in step 59, tone generation processing is performed in step 60.

If it is determined in step 59 that the phrase play mode is selected, a phrase number (key number) is set in step 61. In step 62, a phrase play is started.

In the OFF-event processing in FIG. 7, it is checked in step 64 if the phrase play mode is selected. If NO in step 64, tone OFF processing is performed in step 65. If YES in step 64, the phrase play is stopped in step 66.

Figure 8:
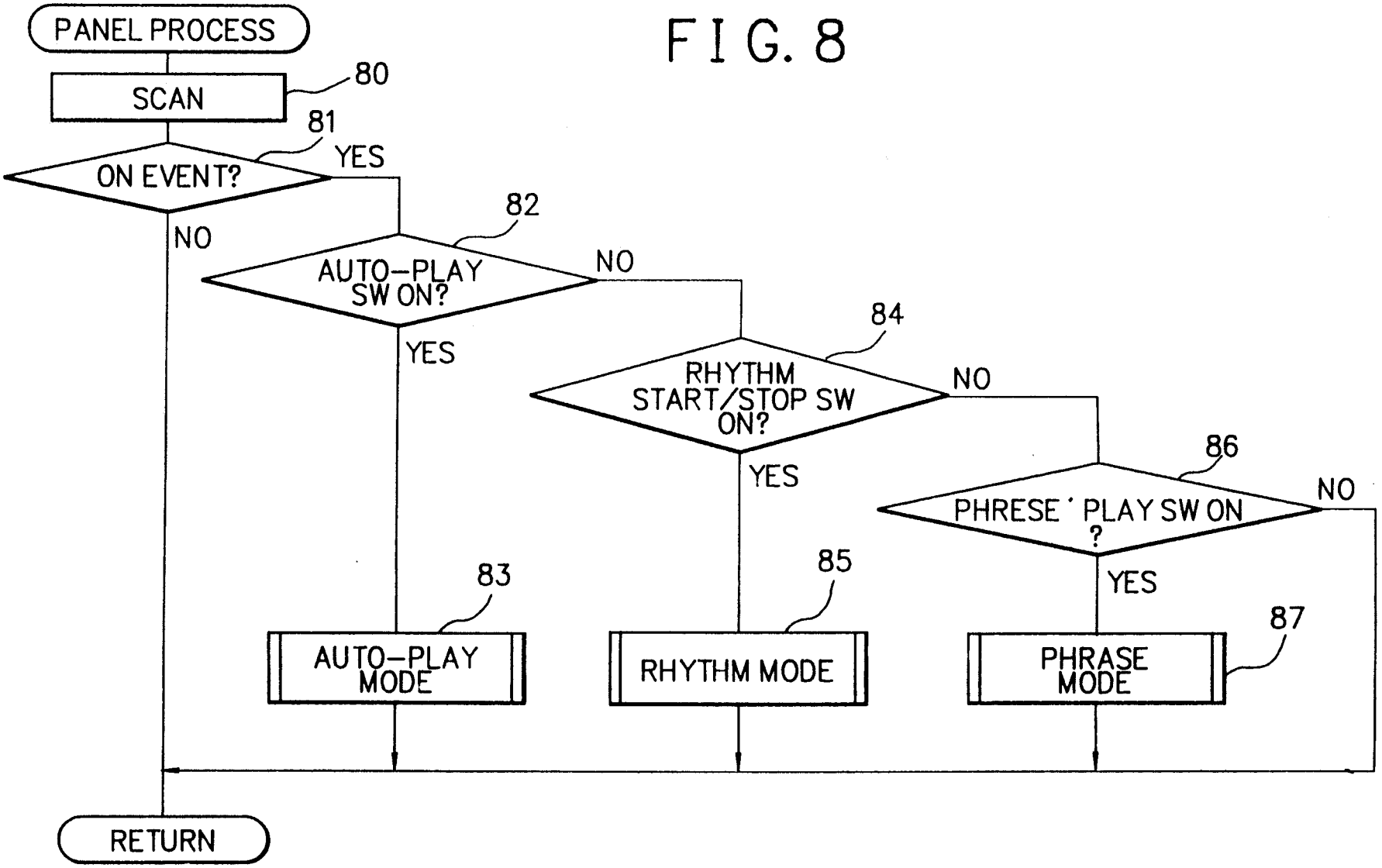

FIG. 8 shows the panel processing. In step 80, scan processing is performed. If an ON-event is detected, the flow advances from step 81 to switch detection processing in steps 82, 84, and 86.

When an auto-play switch of the selection switches 12*a* of the operation panel 12 is turned on, auto-play mode processing is executed in step 83. When a rhythm start/stop switch is turned on, rhythm mode processing is executed in step 85. When a phrase play switch is turned on, phrase mode processing is executed in step 87. In each processing, a corresponding flag is set.

Figure 9:
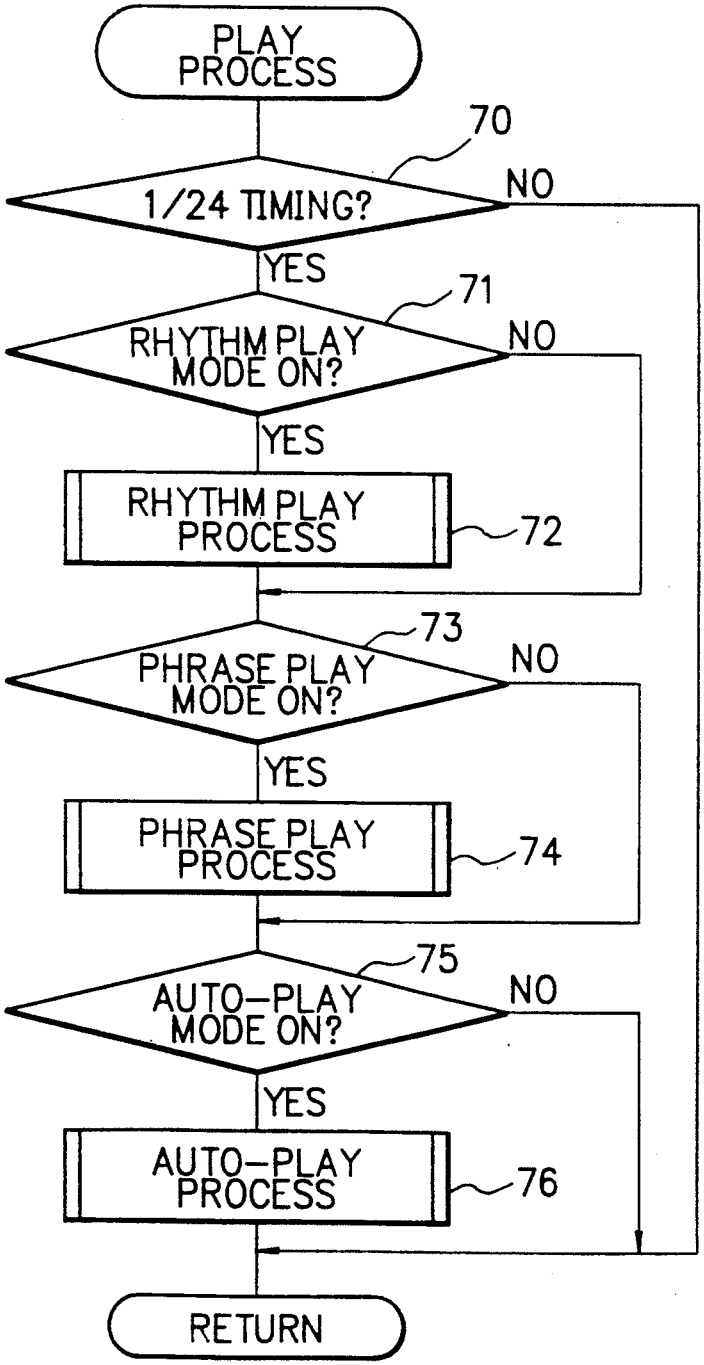

FIG. 9 shows the play processing routine in step 57 in FIG. 7. In step 70, it is checked if the timing is 1/24. If NO in step 70, the flow returns to the main routine.

On the other hand, if it is determined in step 70 that the timing is 1/24, i.e., is a 1/24 timing of one note, the flow advances to step 71 to check if the rhythm play mode is ON. If NO in step 71, the flow advances to step 73 to check if the phrase play mode is ON.

If it is determined in step 71 that the rhythm play mode is ON, the flow advances to step 72 to execute rhythm play processing, and thereafter, the flow advances to step 73.

If it is determined in step 73 that the phrase play mode is not ON, the flow advances to step 75; otherwise, the flow advances to step 74 to execute phrase play processing, and thereafter, the flow advances to step 75.

In step 75, it is checked if the auto-play mode (e.g., chord accompaniment mode) is ON. If NO in step 75, the flow returns to the main routine; otherwise, the flow advances to step 76 to execute auto-play processing.

Figure 10:
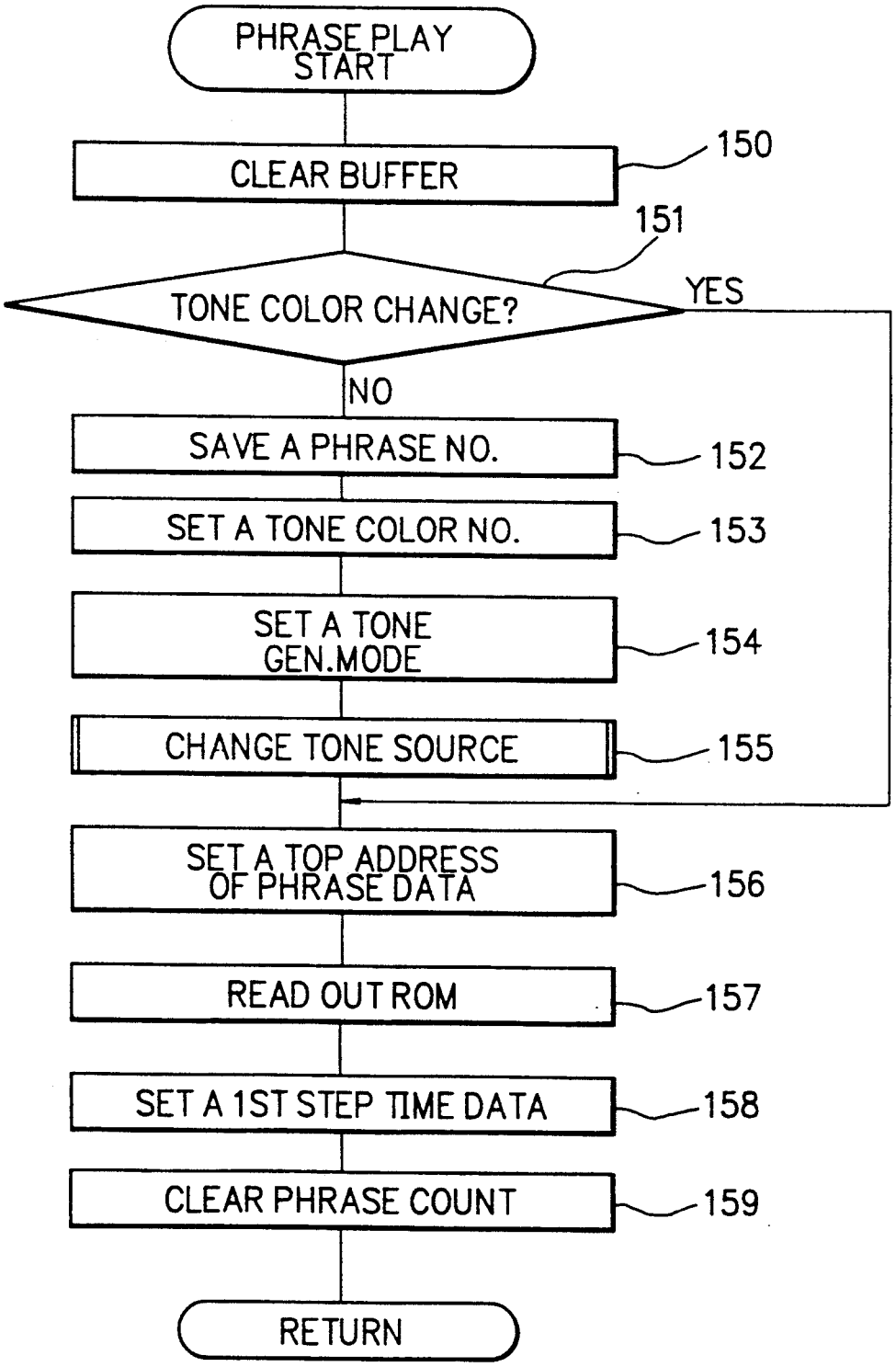

FIG. 10 shows processing executed when the adlib phrase play is started. In step 150, a buffer is cleared, and it is then checked in step 151 if the tone color is changed. If NO in step 151, a phrase number is saved in step 152, a tone color number is set in step 153, and a tone generation mode is set in step 154.

In step 155, processing for changing tone source parameters of a tone source circuit is performed. In step 156, the top address indicated by phrase data written in the phrase data memory 33 (FIG. 2) corresponding to the phrase number is set.

Thereafter, ROM data is read out in step 157. In step 158, first step time data is set, and in step 159, a time base counter of the phrase play is cleared.

Figure 11:
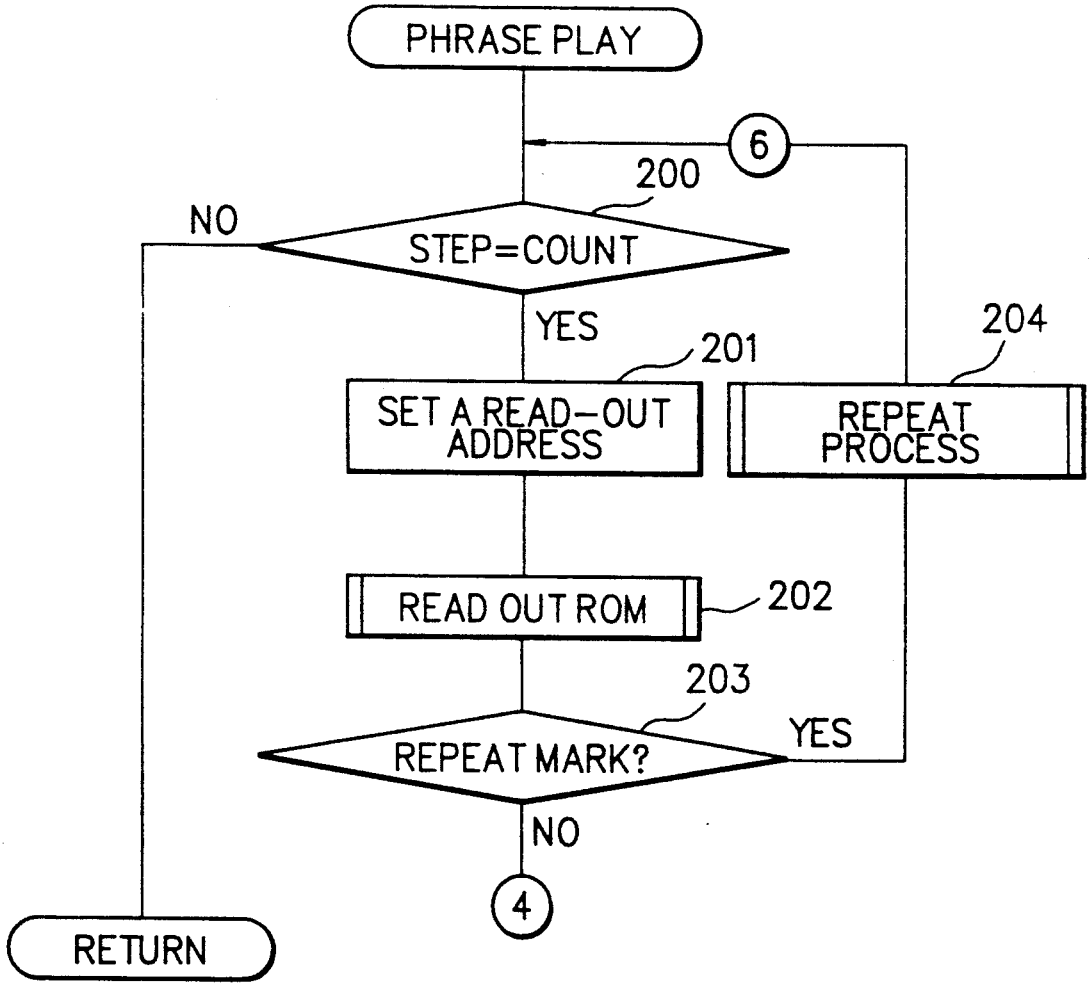
Figure 12:
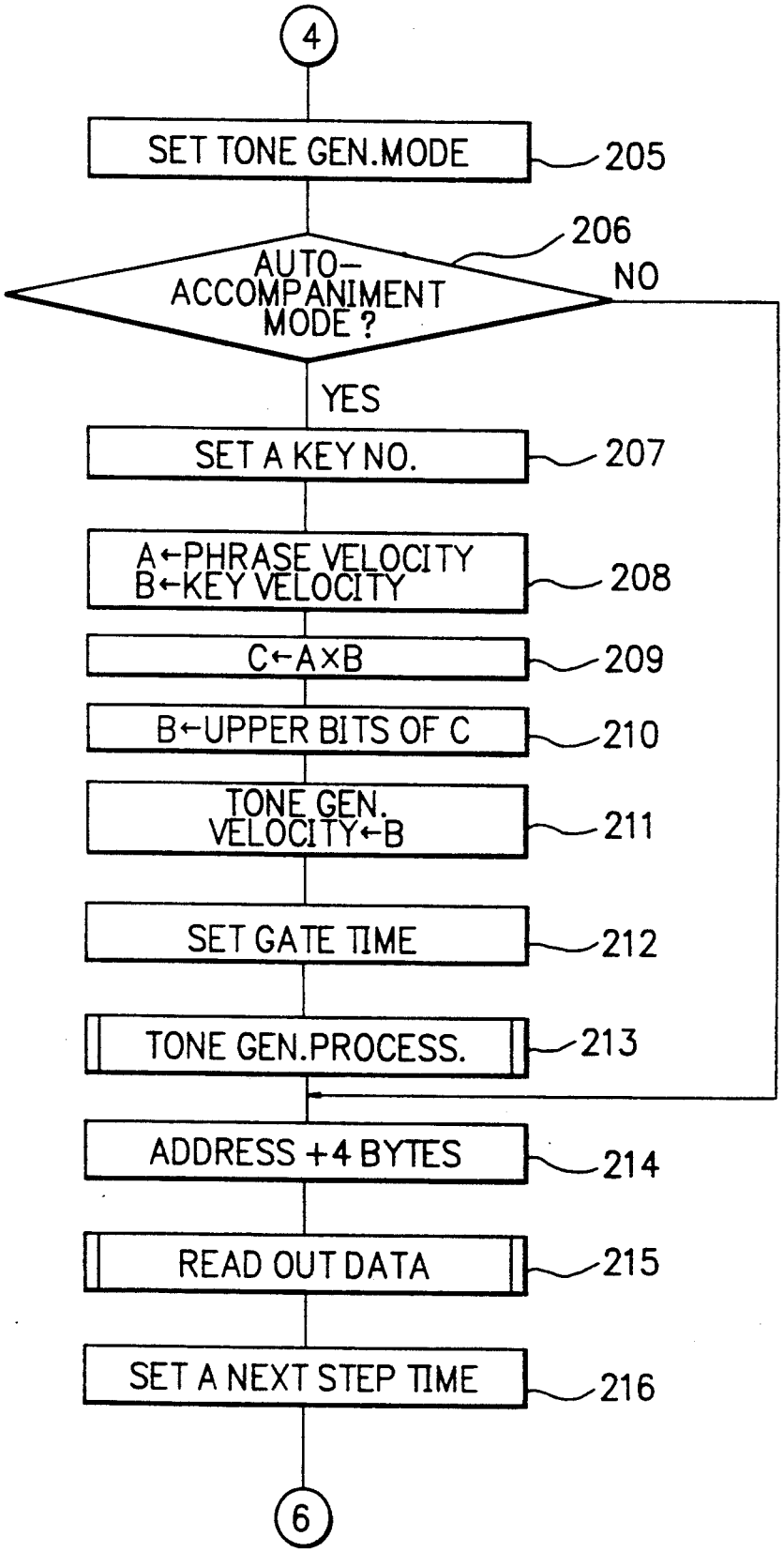

FIGS. 11 and 12 show the phrase play routine. In the routine shown in FIG. 11, if it is determined in step 200 that the count value of the time base counter coincides with the step time, a read address is set (step 201), and note data for four bytes is read out from the ROM 20 (step 202).

It is checked in step 203 if the readout note data is a repeat mark. If YES in step 203, repeat processing is performed in step 204, and the flow returns to the node before step 200.

If it is determined in step 203 that the readout note data is normal note data, the flow advances to step 205 in FIG. 12, and the tone generation mode is set.

It is then checked in step 206 if an auto-accompaniment mode is selected. If YES in step 206, a key number is set in step 207. The flow advances to step 208 to save a phrase velocity value in an A register, and to save a key velocity value in a B register. In step 209, these phrase and key velocity values are multiplied with each other to generate 16-bit data C, as described above.

In step 210, upper 8 bits of the 16-bit data C are extracted, and in step 211, the extracted 8-bit data is set as tone generation velocity data in a register.

The flow then advances to step 212 to set a gate time. In step 213, tone generation processing of a corresponding note is performed. Upon completion of the tone generation processing, the read address is advanced by four bytes in step 214, and note data to be generated next is read out from the ROM 20 in step 215. In step 216, the next step time is set in the buffer, and the flow returns to step 200 in the auto-play routine shown in FIG. 11. Thereafter, the above-mentioned processing is repeated to sequentially generate tones of auto-accompaniment notes.

As described above, a corresponding note data string is read out on the basis of a selected phrase pattern to generate tones. In addition, each tone generation strength data of the note data is multiplied with a key operation strength value, and the product is set as tone generation strength data. Therefore, an adlib play for calling the short-phrase play patterns in correspondence with key operations can be performed, and the tone volume of the adlib play can be varied according to the key depression strengths of the key operations. Thus, even a beginner can make an emotional play with one finger.

What is claimed is:

1. A phrase play apparatus comprising:

note data storage means for storing note data strings constituting a plurality of phrases, each of said plurality of phrases including a series of tones of a plurality of bars per phrase for one of rhythm, chord, melody or combination thereof and assigned to a plurality of keys;

tone generation means for generating tones from the note data strings stored in said note data storage means;

means, responsive to a keyboard operation, for selecting and reading out one of the plurality of phrases corresponding to an operated key of the plurality of keys;

detecting means for detecting a key depression strength of the operated key; and multiplication means for multiplying the detected key depression strength by the one of the plurality of phrases to produce a tone generation strength value and outputting said tone generation strength value to said tone generation means.

2. The apparatus of claim 1, wherein said multiplication means multiplies the tone generation strength value with a correction value.

3. The apparatus of claim 1 or 2, wherein upper bits of the product of the one of the plurality of phrases and the detected key depression strength represents said tone generation strength value.

4. The apparatus of claim 1, further comprising a memory table for storing said plurality of phrases and corresponding key numbers, said memory table storing start addresses of said plurality of phrases stored in said note data storage means as phrase data.

5. The apparatus of claim 4, further comprising rhythm selection means, wherein said memory table stores different phrase data corresponding to types of rhythms, and a set of phrases corresponding to a rhythm are assigned to a group of said plurality of keys upon selection of a rhythm by said rhythm selection means.

* * * * *